US005368169A

United States Patent [19]

Ensor

[11] Patent Number: 5,368,169

[45] Date of Patent: Nov. 29, 1994

[54] SCREEN CONSTRUCTION

[75] Inventor: Paul M. Ensor, Albany, Australia

[73] Assignee: Flexistack Pty Ltd, Welshpool, Australia

[21] Appl. No.: 302,592

[22] PCT Filed: July 24, 1987

[86] PCT. No.: PCT/AU87/00234

§ 371 Date: Apr. 3, 1989

§ 102(e) Date: Apr. 3, 1989

[87] PCT Pub. No.: WO88/00500

PCT Pub. Date: Jan. 28, 1988

[30] Foreign Application Priority Data

Jul. 24, 1986 [AU] Australia ..... PH7113
Dec. 1, 1986 [AU] Australia ..... PH9253

[51] Int. Cl.[5] ..... B07B 1/49

[52] U.S. Cl. ..... 209/403; 209/405; 209/407; 209/305; 209/373

[58] Field of Search ..... 209/305, 373, 403, 405, 209/407; 241/72; 222/143; 206/503, 821

[56] References Cited

U.S. PATENT DOCUMENTS

| | | | |
|---|---|---|---|
| 65,406 | 6/1867 | Ludlow | 209/403 |
| 1,141,727 | 6/1915 | Seaman | 209/680 X |
| 2,197,435 | 4/1940 | Niemeyer | 209/403 |
| 2,326,414 | 1/1940 | Thompson | 206/821 X |
| 2,464,921 | 3/1949 | Chandler | 160/395 |
| 3,035,700 | 5/1962 | McCausland | 209/405 |
| 3,180,537 | 4/1965 | Collins | 222/143 X |
| 3,642,165 | 2/1972 | von der Osten | 206/503 X |
| 3,666,096 | 5/1972 | Riesbeck et al. | 209/405 X |
| 3,800,943 | 4/1974 | Riesbeck et al. | 209/403 X |
| 3,885,672 | 5/1975 | Westenrieder | 222/143 X |
| 3,888,765 | 6/1975 | Bolk | 209/405 X |
| 4,349,109 | 9/1982 | Scordato et al. | 206/503 X |
| 4,848,607 | 7/1989 | Halley | 209/405 X |
| 4,930,636 | 6/1990 | Meadows | 206/503 |

FOREIGN PATENT DOCUMENTS

| | | | |
|---|---|---|---|
| 2189716 | 11/1987 | United Kingdom | 209/403 |

*Primary Examiner*—Robert P. Olszewski
*Assistant Examiner*—Carol Lynn Druzbick
*Attorney, Agent, or Firm*—Ladas & Parry

[57] ABSTRACT

A mesh screen comprising a pair of rings open at each end. A piece of mesh material is releasably clamped between the rings. The inner face of one cylindrical ring is provided with a circumferential groove and a circumferential flange projecting in the same direction as the mouth of the groove. The inner face of the other cylindrical ring is provided with a circumferential flange which is adapted to mate with the circumferential flange of the first cylindrical ring so that the mesh material may be interposed between the flanges, and the free edge of the circumferential flange of the other cylindrical ring is accommodated within the groove.

10 Claims, 7 Drawing Sheets

SCREEN CONSTRUCTION

This invention relates to an improved screen construction.

With screens or sieves operated manually for screening or classifying material according to particle size, there is some difficulty in fixing the mesh material to the screen in a manner which will ensure that the mesh material is maintained in a taut condition. Accordingly, most screens which are sold these days for use in precision screening or classifying applications are of a fixed structure and do not permit easy replacement of the mesh material used therein.

It is an object of the present invention to provide an improved screen construction which permits easy replacement and interchanging of mesh material used therein.

In accordance with one aspect of the invention there is provided a mesh screen comprising at least one pair of cylindrical members each open at an end and a piece of mesh material clamped between the members, characterised in that the inner face of one cylindrical member is provided with a circumferential groove and a circumferential flange projecting in the same direction as the mouth of the groove, and the inner face of the other cylindrical member is provided with a circumferential flange adapted to mate with the circumferential flange the one cylindrical member with the mesh material interposed therebetween and the free edge of the circumferential flange of the other cylindrical member being accommodated within the groove.

With screens or sieves operated manually or mechanically for screening or classifying material according to particle size, each mesh screen is usually constructed as an independent unit with an independent housing.

Consequently, the screening or sieving operation is usually performed separately for each mesh screen containing appropriate sample of material. Such operations can tend to be time consuming when a large number of screening or sieving operations need to be performed independently of each other.

Accordingly, it is a preferred object of the present invention to provide an improved screen construction, wherein a plurality of separate mesh screens may be interconnected so as to be disposed within a single housing to facilitate the screening or sieving operation.

In accordance with another aspect of the present invention, there is provided a partition member for interconnecting and partitioning a plurality of mesh screens of the kind comprising at least one pair of cylindrical members each open at an end and a piece of mesh material clamped between the members, said partition member comprising a further cylindrical member having an inner radially disposed partitioning wall and a pair of opposed axially extending circumferential flange portions, each of said flange portions having an outer axial end of complementary shape to the outer axial end of a cylindrical member of a mesh screen so as to form a spigot in socket connection therewith when said members are brought into mutual engagement, wherein said members may be interconnected to provide a unitary housing for the mesh screens.

In accordance with a further aspect of the present invention, there is provided a composite screening unit comprising:

a plurality of mesh screens each having at least one pair of cylindrical members open at each end and a piece of mesh material clamped between the members: and a partition member comprising a further cylindrical member having an inner radially disposed partitioning wall and a pair of opposed axially extending circumferential flange portions;

wherein each of said flange portions has an outer axial end of complementary shape to the outer axial end of a cylindrical member of a mesh screen, so as to form a spigot in socket connection therewith when said members are brought into mutual engagement, whereby said members are interconnected to provide a unitary housing for the mesh screens.

In accordance with another aspect of the present invention there is provided a tool for levering apart interconnected cylindrical members of the kinds hereinbefore described, comprising an elongate lever having a handle portion and a pair of longitudinally spaced outwardly projecting spigots, wherein said spigots are intended to be located within external grooves of adjacent interconnected cylindrical members, such that a rotating force may be applied to the handle of the lever, effectively applying an outwardly diverging axial force to each cylindrical member so as to force them apart.

The invention will be better understood in the light of the following description of two specific embodiments thereof. The description is made with reference to the accompanying drawings wherein.

The first embodiment is directed towards a mesh screen.

Figure 1:
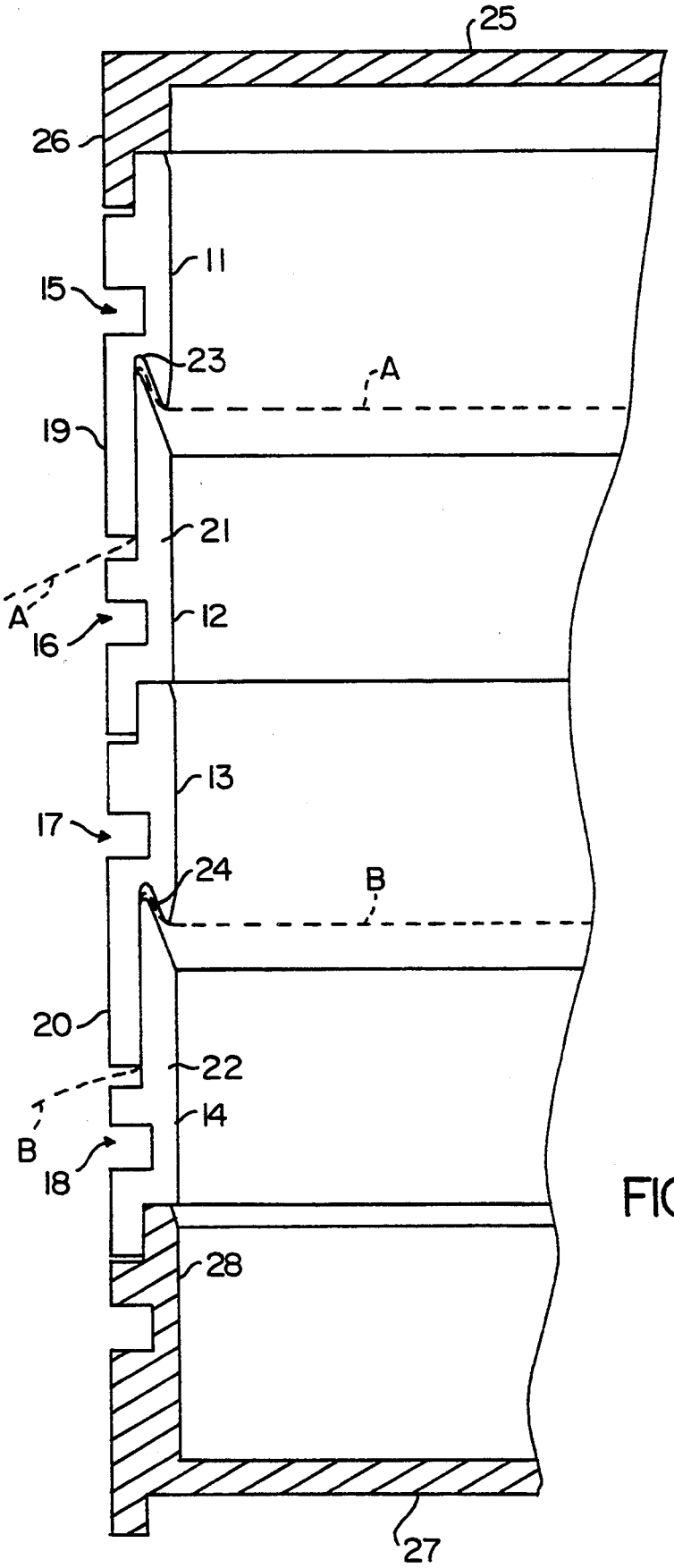
FIG. 1 is a fragmentary sectional elevation showing a series of cylindrical members axially connected to clamp mesh material therebetween and terminated at opposite ends by end cover members to form a mesh screen as described in the first embodiment.

As shown in FIG. 1 the mesh screen comprises an assembly of cylindrical members 11, 12, 13 and 14 clamped together, with mesh material A and B clamped between members 11 and 12 and members 13 and 14 respectively.

The cylindrical members have an axial length which is small in relation to their diameter and each is provided with an external groove 15, 16, 17 and 18. The outer face of the members 11 and 13 are each provided with a downwardly projecting flange 19 and 20 respectively whilst the members 12 and 14 are provided with upwardly projecting flanges 21 and 22. The upper edges of the flanges 21 and 22 are tapered outwardly and are so shaped to fit into grooves 23 and 24 respectively provided on the inner face of the members 11 and 13.

To assemble the screen, pieces of nylon mesh material A and B of the required size are placed over the tapered upper edges of flanges 21 and 22 with the outer portion of the mesh material positioned between the flanges 19 and 21, and 20 and 22, respectively. The dimensions of the members are such that the mesh is clamped firmly between the respective flanges. When the cylindrical members are pushed firmly together, axially, the movement of the tapered upper edges of flanges 21 and 22 into the respective grooves 23 and 24 applies tension to the mesh material.

If desired a number of clamps (not shown) are provided on the external face of the assembly to prevent the cylindrical members coming apart. In addition, a tog end cover member 25 provided with a downwardly projecting skirt 26 may be fitted to the upper end of member 11. Likewise a bottom end cover member 27 provided with an upwardly projecting skirt 28 may be fitted to the lower end of member 14.

It should be appreciated that the inner walls of the respective flanges are aligned so that there is no place where material may accumulate and possibly contaminate the next sample of material passing through the screen. As the components are firmly clamped together a lever 61 is provided with two spaced outwardly projecting spigots **63*a* and 63*b*, which are adapted to fit into the grooves 15, 16, 17 and 18**. The lever is rotated about one of the spigots to apply force axially to separate the cylindrical members axially.

The second embodiment is directed towards a composite screening unit comprising a series of mesh screens.

Figure 4:
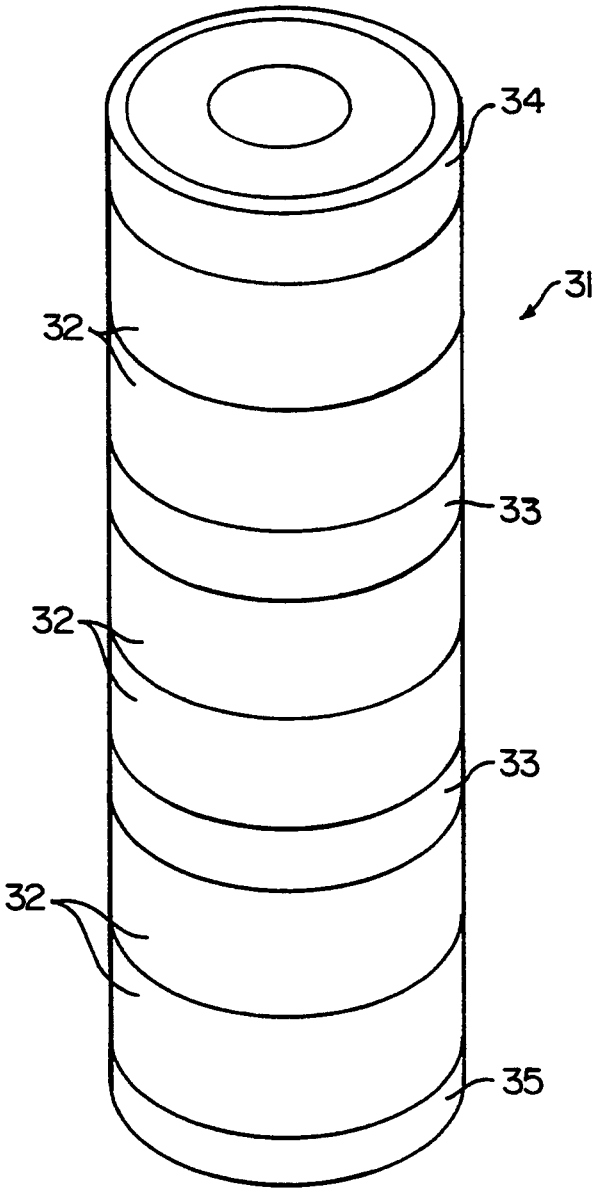
FIG. 4 is a perspective view of a composite screening unit comprising three mesh screens connected to each other by partition members.
Figure 5:
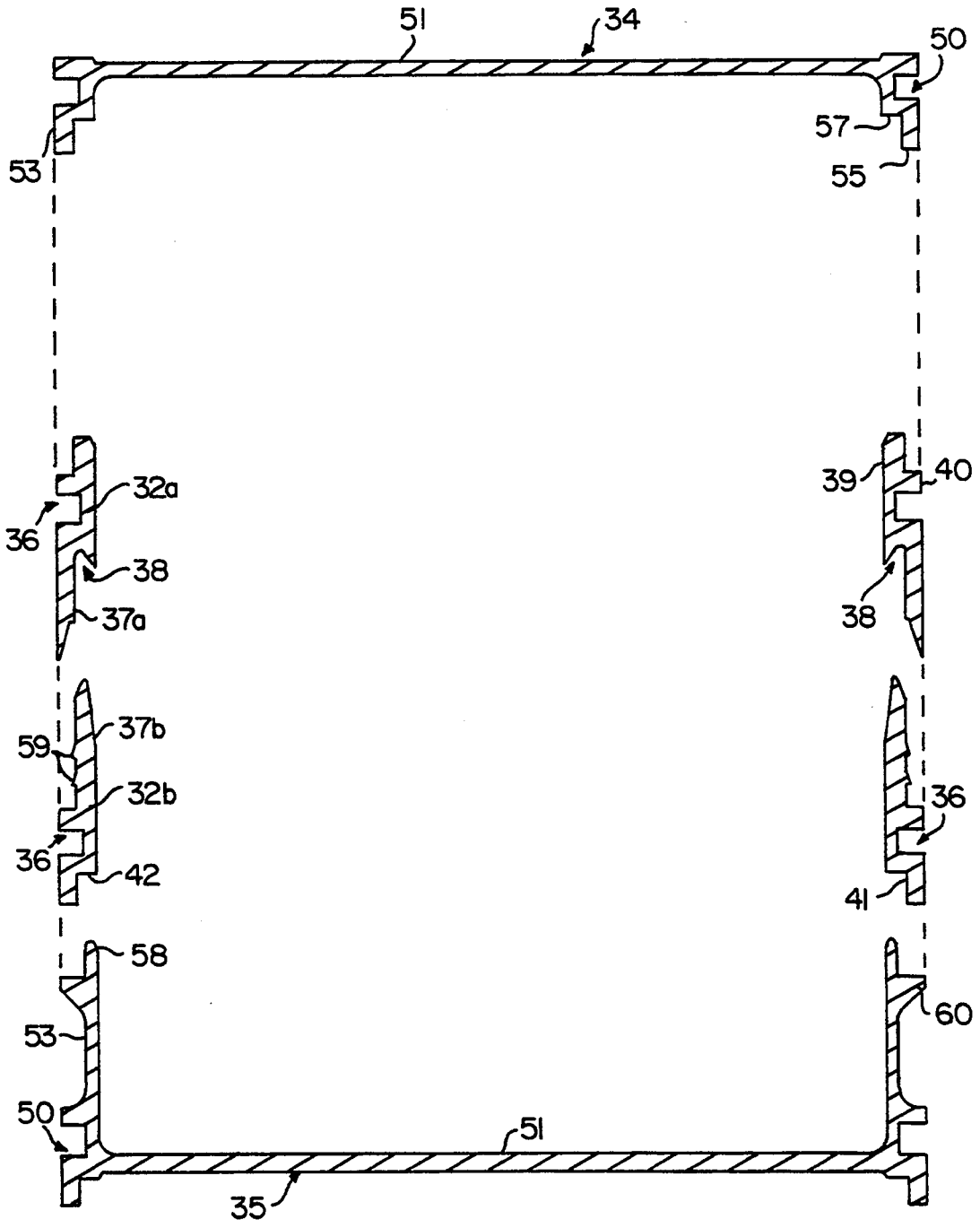
FIG. 5 is an exploded sectional side elevation showing the cylindrical members of the mesh screen, a partition member, and an end cover member disposed relatively of the other members for axial engagement so as to define a compartment of a mesh screen, as described in-the second embodiment.

As shown in the drawings, and particularly FIGS. 4 and 5, the composite screening unit 31 comprises a series mesh screens 32 which are interconnected by partition members 33 and terminated at opposite ends by a lid cover member 34 and a base cover member 35, respectively, the latter being formed by an end partition member.

The mesh screens 32 essentially comprise a pair of cylindrical members **32*a*, 32*b* and a piece of mesh material clamped between the members (not shown). The cylindrical members have an axial length which is small in relation to their diameter and each is provided with an external circumferential groove 36. The outer face of the upper cylindrical member 32*a* is provided with a downwardly projecting flange 37, whilst the lower member 32*b* is provided with an upwardly projecting flange 37*b*, the flanges projecting in the opposite axial directions of the members. The outer edges of the flanges 37 are each tapered outwardly and when brought into mutual engagement with each other, are intended to receive the mesh material therebetween. The upper edge of the flange 37*b* is particularly shaped to fit into an inner groove 38 provided on the inner face of the member 32*a*** and thus enable the mesh material to be clampingly engaged therebetween.

As shown at FIG. 5 of the drawings, the upper cylindrical member **32*a* is formed with an axial end 39 opposite its lower flange 37*a* to define a spigot portion. An outwardly projecting rib 40 is provided between the external groove 36 and the spigot portion 39 to enable a socket portion of another cylindrical member to be connected to the spigot portion thereby forming a spigot in socket connection. Conversely, the lower cylindrical member 34*b* is formed with its lower axial end 41 opposite the upwardly projecting flange 37*b* to define a socket portion. The lower end 41 is provided with an inner step 42** to enable a spigot portion of a cylindrical member to be accommodated within the socket end in a spigot in socket connection.

Figure 2:
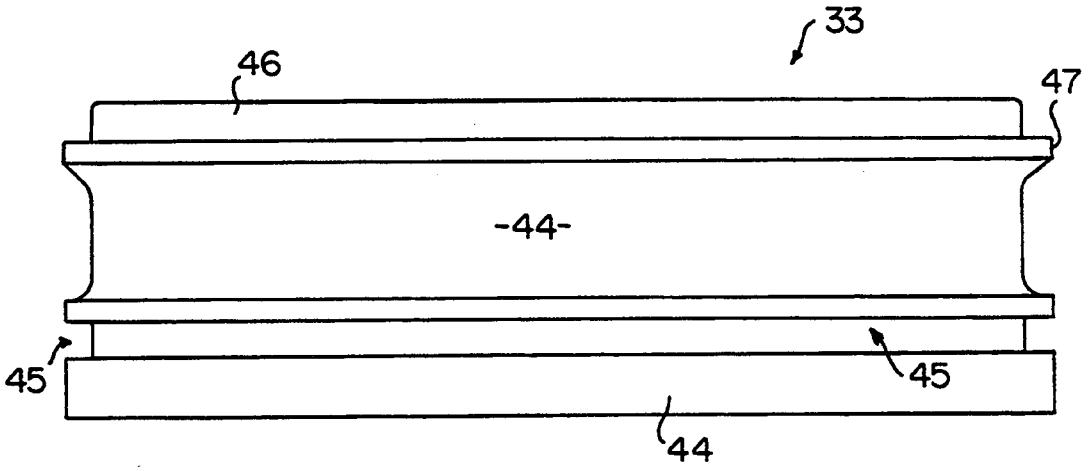
FIG. 2 is a side view of the partition member.
Figure 3:
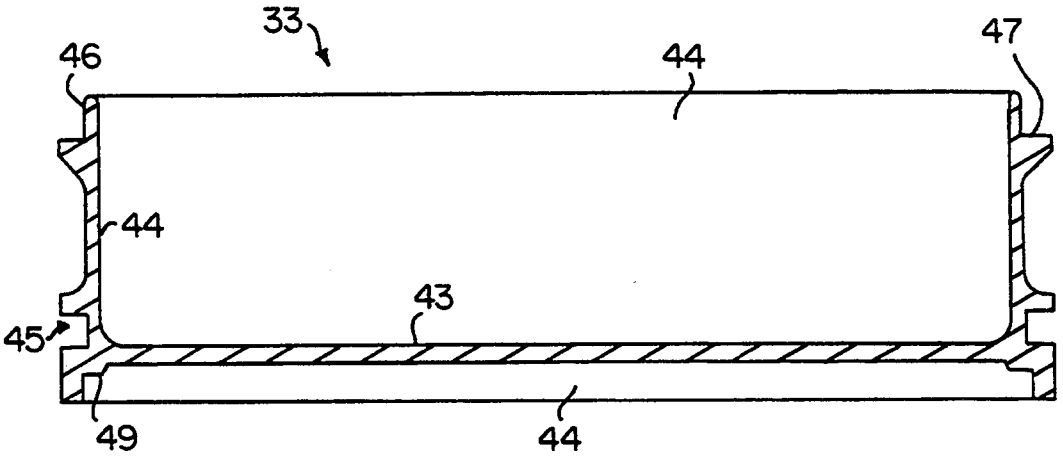
FIG. 3 is a sectional view of FIG. 2, taken along a vertical section through the centre of the member.

The partition member 33 shown in detail at FIGS. 2 and 3 of the drawings and in cross section at FIG. 5, essentially comprises a further cylindrical member having an inner radially disposed partition wall 43 and a pair of opposed axially extending circumferential flange portions 44. As in the case with the other cylindrical members, the outer face of the partitioning member is formed with an external circumferential groove 45 intermediate the flange portion 44.

The upper flange portion **44*a* projects axially a distance substantially further than that of the lower flange portion 44*b* relative to the location of the partitioning wall 43. Each of the flange portions have an outer end of complementary shape to the outer axial end of one or the other of the cylindrical members 32 of the mesh screen. In the present embodiment, the upper flange portion 44*a* has its outer axial end 46 formed with a spigot portion and a radially projecting rib 47 spaced from the distal end thereof which is adapted to be axially accommodated within the socket portion 41 of the lower cylindrical member 32*b* of the mesh screen, as shown at FIG. 5 of the drawings. Conversely, the lower flange portion 44*b* of the partition member has its outer axial end 48 formed with a socket portion and a step 49 spaced from the distal end thereof which is adapted to axially accommodate the spigot portion 39 of the upper cylindrical member 32*a* of an adjacent mesh screen (not shown in FIG. 5**).

The end cover members 34 and 35 are each provided with an external groove 50 along their outer face and further comprise an end wall 51 and an axially projecting flange portion 53. In the case of the lid cover member 34, the end wall 51 provides an end cover to the top mesh screen and, as shown at FIG. 5 of the drawings, the flange portion 53 projects downwardly and has its outer end 55 formed with a socket portion and inner step 57 so as to axially accommodate the spigot end 39 of the upper cylindrical member **32*a*. On the other hand, the base cover member 35 has the outer end of its flange portion provided with a spigot end 58 and outer rib 60 to be axially accommodated with the socket end of a lower cylindrical member 32*b* of a mesh screen so that the end wall 51** thereof may form the base of the bottom mesh screen.

As previously mentioned, the base cover member 35 in the present embodiment is in fact formed by a partition member, where the upper flange portion **44*a* defines the flange portion 53 of the base cover member, the partitioning wall 43 defines the end 51, and the radially projecting rib 47 defines the outer rib 60. The axial extent of the lower flange portion 44*b* is much less than that of the upper flange portion 44*a*** of the end partition member to provide stability to the member when connected as a base cover member by lowering the centre of gravity of the stacked members as a whole.

In assembling the unit, firstly each of the mesh screens are assembled respectively by positioning pieces of nylon mesh material of the required mesh size over the tapered upper edges of the flanges **37*b* of each mesh screen with the outer portion of the mesh material positioned between the opposing flanges 37*a* and 37*b* of complementary cylindrical members 32. The dimensions of the flanges and members are such that the mesh is clamped firmly between the respected flanges. Subsequently, the cylindrical members may be pushed firmly together in an axial direction so that the tapered upper edges of the flanges 37***b* may be firmly accommodated within the complementary grooves 38 of the upper members, applying tension to the clamped mesh material.

In a preferred arrangement of the embodiment, the upwardly projecting flange 37*b* of the lower cylindrical member is provided with a series of circumferential locking collars 59 about its outer face to facilitate locking with the downwardly projecting flange 37*a* of the upper cylindrical member and also clamping of the mesh material.

After assembling the mesh screens, a partitioning member 33 may be axially connected to the socket end of a lower cylindrical member 32*b* of a particular screen so as define the base for the compartment thereof, or alternatively to the spigot end 39 of an upper cylindrical member to define the top end of another screen. By connecting partition members to mesh screens in this manner, a series of mesh screens may be constructed having a unitary housing, but which have their compartments separated from each other by.. means of the partition member. After assembling the required number of mesh screens, the top screen may have a lid cover member 34 axially fitted to the upper cylindrical member thereof and a base cover member 35 axially fitted to the lower cylindrical member of the bottom mesh screen, completing the construction of the composite screening unit. Subsequently, the unit as a whole may be placed within a vibrating machine to effect mechanical screening or sieving of the contents within the mesh screens or may be used in a manual screening or sieving operation. Consequently, the screening or sieving operation may be simultaneously performed for each of the mesh screens with in the unit, wherein the screening or sieving performed in one compartment of a mesh screen is effected independently of an adjacent compartment by virtue of the provision of the partition member.

If desired, a number of clamps (not shown) may be provided on the external face of the assembly to prevent the cylindrical members from coming apart.

Figure 6:
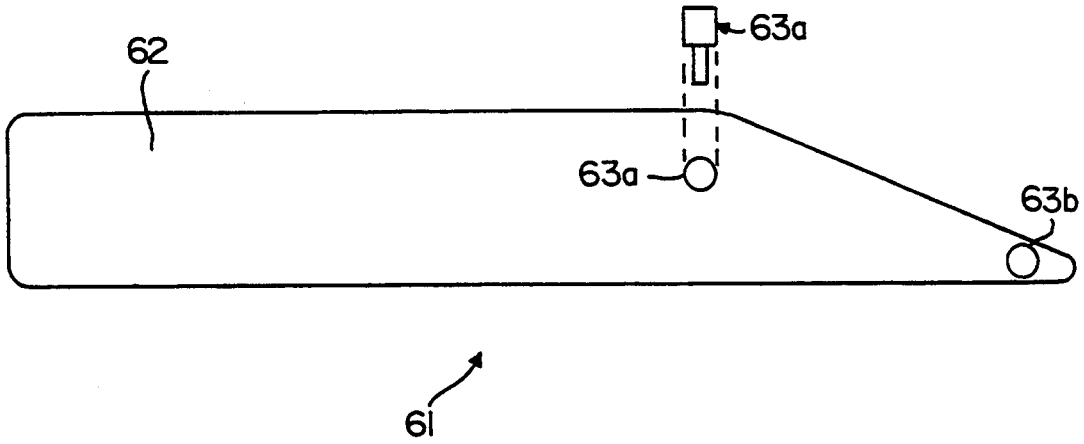
FIG. 6 is a side view of the lever.

After completing the screening or sieving operation, since the components are usually firmly clamped together, a tool in the form of the elongate lever 61, shown at FIG. 6 of the drawings is provided with a handle portion 63 at one end and two spaced outwardly projecting spigots 63*a* and 63*b* which are particularly adapted to fit into the external circumferential grooves of adjacent cylindrical members so as to lever them apart when desired. Thus, the lever 61 may be rotated about one of the spigots located in an adjacent groove by applying a rotating force to the handle, so as to apply an outwardly diverging axial force to each cylindrical member, forcing them apart.

An important aspect of the present embodiments, is that much flexibility is provided by adopting the screen construction herein described in enabling a variety of different mesh material to be utilised by the safe apparatus. This arises due to the relatively simple process of interconnecting or separating apart cooperating cylindrical members of a mesh screen, whereby mesh material of appropriate size can simply be inserted between the opposing flanges or removed therefrom to be replaced by another piece of material. In this manner, a screen assembly can enable screening or sieving operations to be performed on a range of mesh material varying in size from 0.2 microns to 1700 microns.

Figure 7:
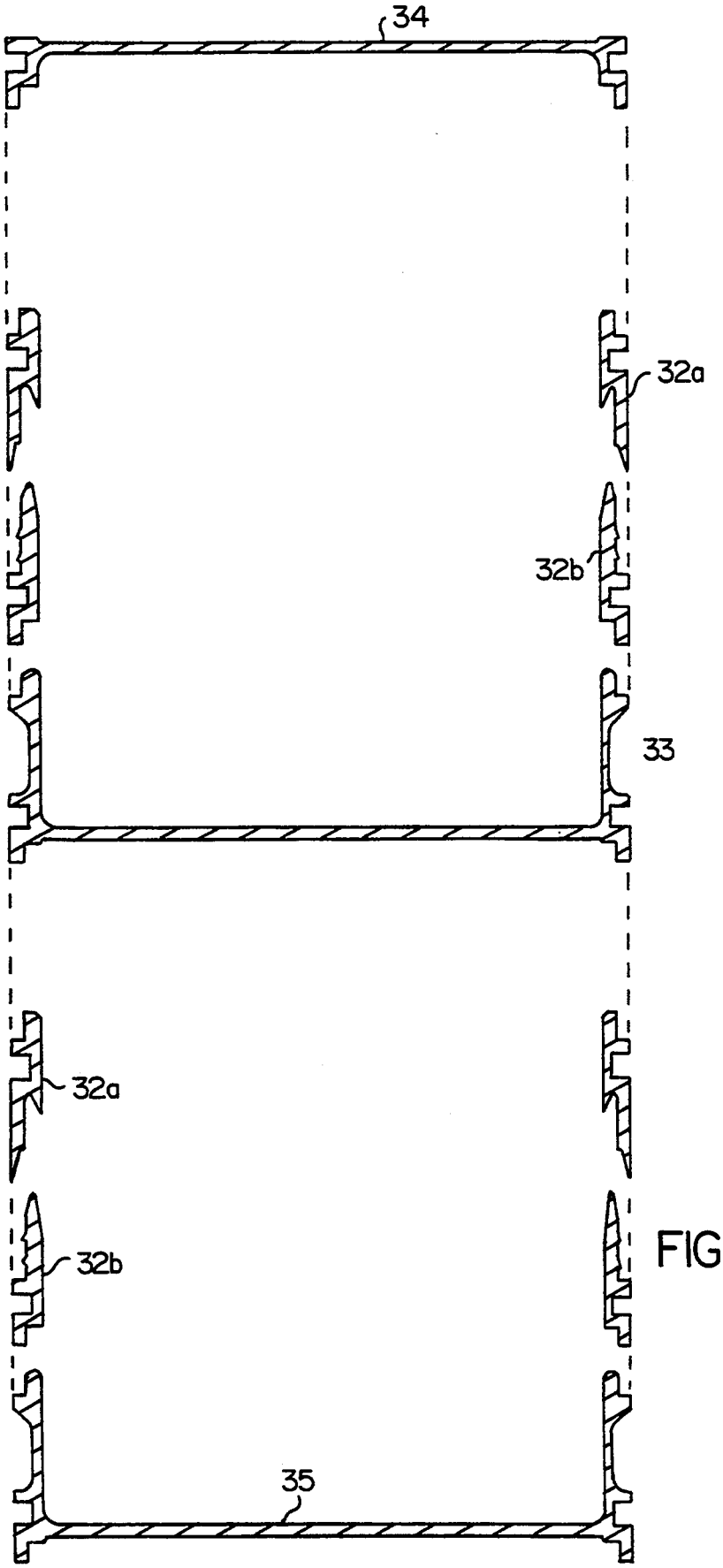
FIG. 7 is an exploded side elevation showing the cylindrical members of two mesh screens separated by a partition member to form adjacent compartments in a unitary housing.
Figure 8:
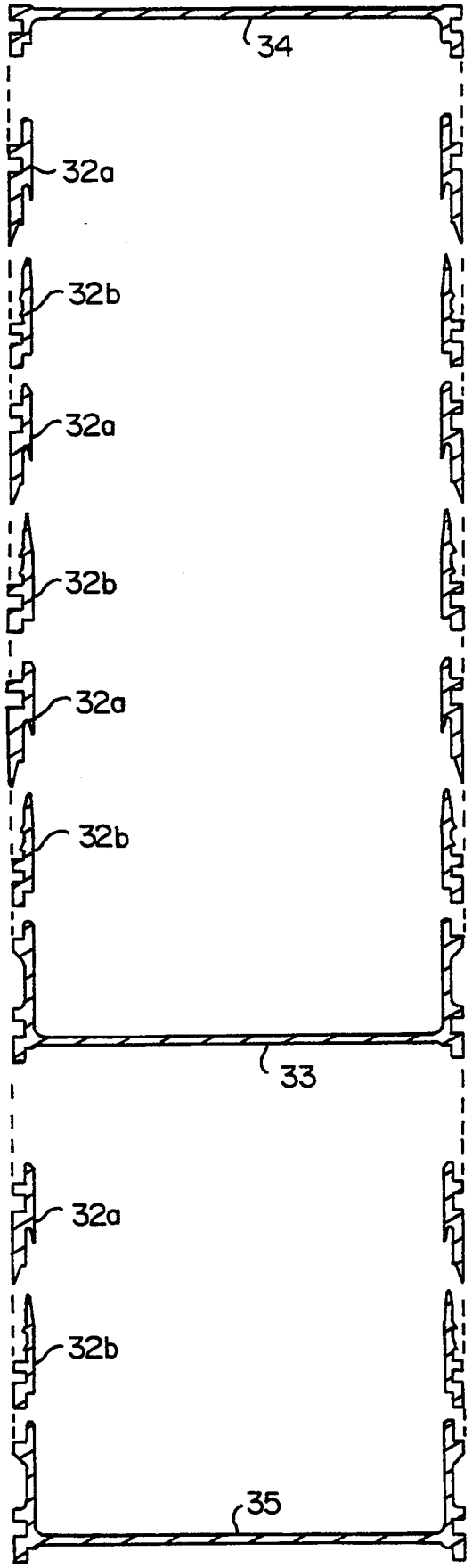
FIG. 8 is an exploded side elevation showing the cylindrical members of a series of stacked mesh screens within one compartment being adjoined to a mesh screen of another compartment by a partition member.

Furthermore, an important advantage of the present embodiments, is the speed in which a screening or sieving operation may be performed due to the ability to assemble a large number of mesh screens in the one composite unit. Examples of different combinations of cylindrical members to form composite mesh screen units are shown at FIGS. 7 and 8.

It should be appreciated that the scope of the present invention is not limited to the scope of the particular embodiments herein described.

I claim:

1. A mesh screen for screening particulate material comprising: at least one pair of cylindrical members each open at an end and a piece of mesh material clamped between the members, an inner face of one cylindrical member being provided with a circumferential groove having a pair of side walls, one of the side walls being disposed radially inwardly and being contiguous with said inner face, and another of the side walls being disposed radially outwardly to form a circumferential flange contiguous with an outer face of the other cylindrical member, and an inner face of the other cylindrical member being provided with a circumferential flange adapted to engage in the circumferential groove of the one cylindrical member with the mesh material interposed there between so as to form a lap joint; wherein the circumferential flange of the other cylindrical member has a free end which is wholly accommodated within the circumferential groove, said circumferential groove and said free end being of complementary shape to provide clamping of said mesh material therebetween and to apply tension to said mesh material upon convergent axial movement between said cylindrical members, the engagement of the circumferential flanges permitting exit of extraneous mesh material from within said joint.

2. A mesh screen as claimed in claim 1, wherein said cylindrical members are each provided with an outer external groove which remains exposed when said cylindrical members are brought into mutual engagement, to facilitate prizing said members apart.

3. A mesh screen as claimed in claim 1, wherein axial ends of said cylindrical members opposite the flanges thereof are adapted to adjoin an adjacent cylindrical member.

4. A mesh screen as claimed in claim 3, wherein said adjacent cylindrical member may be one of: an end cover member to enclose the end of said mesh screen, a partition member to facilitate interconnection to another mesh screen whilst maintaining isolation between said mesh screens, or a cylindrical member of another mesh screen to provide different screening layers each of which communicate with adjacent mesh screens.

5. A mesh screen as claimed in claim 3, wherein one of said axial ends forms a groove and the other a tongue to adjoin complementary configured axial ends of said adjacent members in a tongue in groove connection.

6. A mesh screen as claimed in claim 4 wherein said partition member comprises a further cylindrical member having an inner radially disposed partitioning wall and a pair of opposed axially extending circumferential flange portions, each of said flange portions having an outer axial end of complementary shape to the outer axial end of a cylindrical member of a mesh screen so as to form a tongue in groove connection therewith when said members are brought into mutual engagement, wherein said members may be interconnected to provide a unitary housing for the mesh screens.

7. A partition member for interconnecting and partitioning a plurality of mesh screens of the kind claimed in claim 1, said partition member comprising a further cylindrical member having an inner radially disposed partitioning wall and a pair of opposed axially extending circumferential flange portions, each of said flange portions having an outer axial end of complementary shape to the outer axial end of a cylindrical member of a mesh screen so as to form a tongue in groove connection therewith when said members are brought into mutual engagement, wherein said members may be interconnected to provide a unitary housing for the mesh screens.

8. A mesh screen as claimed in claim 1, wherein said inner faces of the respective cylindrical members are disposed in general axial alignment.

9. A mesh screen as claimed in claim 1 wherein an outer face of the circumferential flange of said other cylindrical member is provided with a series of locking collars projecting radially outwardly to engage said mesh screen and facilitate locking engagement with the circumferential flange of said one cylindrical member.

10. A composite screening unit comprising:

a plurality of mesh screens as claimed in claim 1, each having at least one pair of cylindrical members open at each end and a piece of mesh material clamped between the members; and a partition member comprising a further cylindrical member having an inner radially disposed partitioning wall and a pair of opposed axially extending circumferential flange portions;

wherein each of said flange portions has an outer axial end of complementary shape to the outer axial end of a cylindrical member of a mesh screen, so as to form a tongue in groove connection therewith when said members are brought into mutual engagement, whereby said members are interconnected to provide a unitary housing for the mesh screens.

* * * * *